US006305845B1

(12) United States Patent
Navin

(10) Patent No.: US 6,305,845 B1
(45) Date of Patent: Oct. 23, 2001

(54) LINED BULK BAG

(75) Inventor: Craig Proctor Navin, Flowery Branch, GA (US)

(73) Assignee: Grayling Industries, Inc., Alpharetta, GA (US)

( * ) Notice: Subject to any disclaimer, the term of this patent is extended or adjusted under 35 U.S.C. 154(b) by 0 days.

(21) Appl. No.: 09/499,168

(22) Filed: Feb. 7, 2000

(51) Int. Cl.[7] ..... B65D 33/24

(52) U.S. Cl. ..... 383/67; 383/71; 383/78; 383/109

(58) Field of Search ..... 383/67, 109, 71, 383/78

(56) References Cited

U.S. PATENT DOCUMENTS

| | | | | |
|---|---|---|---|---|
| 3,961,655 | * | 6/1976 | Nattrass et al. | 383/67 X |
| 4,143,796 | * | 3/1979 | Williamson et al. | 383/67 X |
| 4,364,424 | * | 12/1982 | Nattrass | 383/67 X |
| 4,457,456 | * | 7/1984 | Derby et al. | 383/67 X |
| 4,596,040 | | 6/1986 | LaFleur et al. . | |
| 4,597,102 | | 6/1986 | Nattrass . | |
| 4,759,473 | * | 7/1988 | Derby et al. | 383/67 X |
| 4,817,824 | * | 4/1989 | LaFleur et al. | 383/67 X |
| 4,874,258 | | 10/1989 | Marino . | |
| 4,917,266 | * | 4/1990 | Kellenberger et al. | 383/67 X |
| 4,917,507 | * | 4/1990 | Davidson | 383/67 |
| 5,192,134 | | 3/1993 | Polett . | |
| 5,340,218 | * | 8/1994 | Cuthbertson | 383/67 |
| 5,484,207 | * | 1/1996 | Schnaars et al. | 383/67 |
| 5,529,393 | | 6/1996 | Polet . | |
| 5,536,086 | * | 7/1996 | Nattrass | 383/67 |
| 5,762,421 | | 6/1998 | Ross . | |

FOREIGN PATENT DOCUMENTS 88830224 10/1989 (EP) .

OTHER PUBLICATIONS

*Upgrading to form–fit bulk bag liner,* May 1995 issue of *Powder and Bulk Engineering.*

* cited by examiner

*Primary Examiner*—Jes F. Pascua
(74) *Attorney, Agent, or Firm*—Baker, Donelson, Bearman & Caldwell

(57) ABSTRACT

A container for bulk materials comprises a flexible bulk bag lined with a flexible liner. The bulk bag has a discharge opening that is coverable by a flap. The liner has a discharge spout fastened to the bag flap and releasibly closed by tie off means. The container may be emptied by pulling the flap to a position opening the bag discharge opening and rendering the liner discharge tie-off means accessible for release to open and empty the liner and bag.

2 Claims, 4 Drawing Sheets

LINED BULK BAG

TECHNICAL FIELD

This invention relates generally to lined bulk bags type containers, and particularly to the discharge chutes or spouts of lined bulk bags.

BACKGROUND OF THE INVENTION

Materials in granular and powder form are typically stored and transported in large containers, commonly referred to in the industry as bulk bags or fiber intermediate bulk containers (F.I.B.C.). These bulk bags are usually made of woven fabrics such as woven polypropylene which are capable of holding large, heavy quantities of materials, typically weighing a ton or so. Liners are commonly used for the interior of bulk bags to provide a moisture barrier or to render the bag capable of containing liquids. Conventional liners are made of flexible materials such as polyethylene or nylon that are either tubular, i.e. tube liners, or specifically configured to conform to the shape of the bulk bag, i.e. form-fitted liners. Exemplary of such lined bulk bags is that shown in U.S. Pat. No. 5,762,421.

In order to unload a lined bulk bag, both the bulk bag and its liner are commonly provided with discharge chutes or spouts that depend from their bottoms. Form fitted liners have distinct spouts that extend from the liner bottom. The discharge spouts of tube liners however are indistinct, they merely being a bottom portion of the tube that has been contracted to fit through the discharge spout of the bulk bag.

Prior to being unloaded the liner discharge spout has been tied off with a tie cord and tucked away to one side of the bag spout between the bottom of the liner and bottom of the bag. The bag spout is usually also tied off. To unload the bag it is suspended as by four corner loops over a hopper. The bag spout is then untied and unfurled into its tubular shape. A worker then reaches up through the bag spout and feels for the tied off liner spout. Manually locating and grabbing it below the tie off is not an easy task since the exposed bottom area of the liner is wrinkled. This wrinkling is extensive where the liner is a tube type liner since its spout has been formed by contracting and wrinkling a bottom portion of itself. Once located it still is difficult to dislodge the liner spout from its position sandwiched between the bottom of the liner and bag due to the weight of the load. Note that a fully loaded bulk bag can easily weight several thousand pounds. Once the liner spout is located and pulled down into the bag spout, its tie off becomes manually accessible. After the spouts have been placed over the hopper, the liner tie off is released whereupon material flows down through the bag and liner spouts and into the hopper.

It thus is seen that the unloading of lined bulk bags has been a challenging task with risks of both personal injury and of accidental discharge. Were a liner bulk bag to be devised that would facilitate unloading and reduce these risks, a distinct advantage would be achieved.

Accordingly, it is to the provision of such that this invention is primarily directed.

SUMMARY OF THE INVENTION

In a preferred form of the invention a container for bulk materials comprises a flexible bulk bag lined with a flexible liner. The bulk bag has a discharge opening that is coverable by a flap. The liner has a discharge spout fastened to the bag flap and releasibly closed by tie off means. So constructed, the container may be emptied by pulling the flap to a position opening the bag discharge opening which pulls the liner spout down through the bag opening and renders the liner discharge tie-off means accessible for release. The liner may be a fit-to-form type or a tube type. The bulk bag itself preferably has a bottom closure which may be in the form of a duffel closure or of a pedal closure.

DETAILED DESCRIPTION

Figure 1:
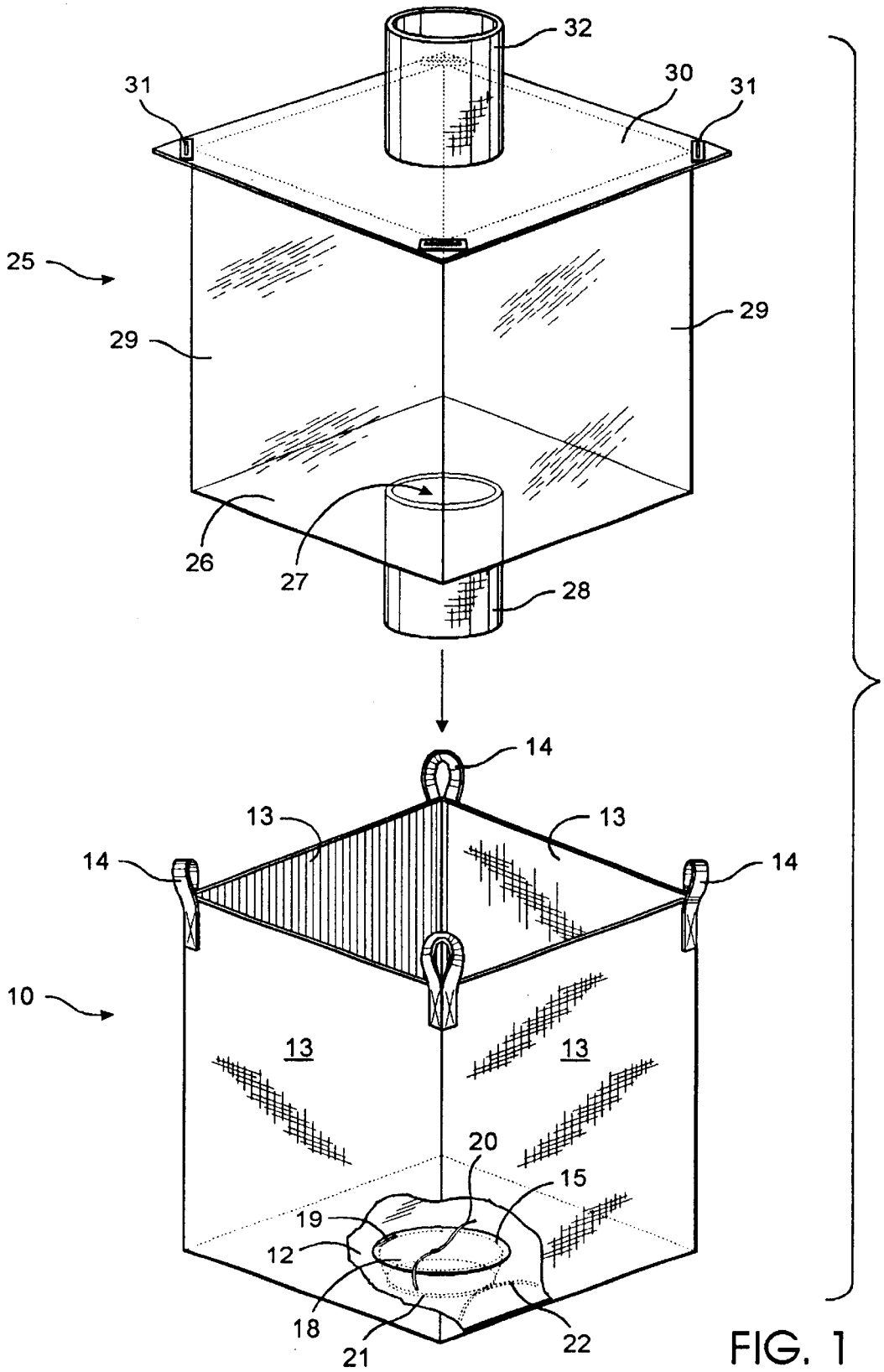
FIG. 1 is a perspective view of a lined bulk bag type container that embodies principles of the invention in a preferred form with the liner shown separated from the bulk bag.

With reference in more detail to the drawing, there is shown a bulk bag 10 made of woven polypropylene. The bag has a bottom 12 from which four sides 13 upwardly extend. Lifting straps 14 are attached to the top corners of the sides. The bottom 12 has a circular opening 15 in its center. A disc shaped flap 18, that has a diameter slightly larger than the diameter of the opening 15, is attached by a line of stitching 19 to the inside of the bottom 12. A tie cord 20 is attached to the top of the flap 18. A sleeve 21 of a duffle closure depends from the bottom 12 about the opening 15. The bottom of the sleeve has an encircling draw cord 22.

The bulk bag has a plastic form fitted liner 25 having a bottom 26 with a central opening 27 from which a plastic discharge spout or chute 28 depends. The liner has sides 29 that extend upwardly from the bottom 26 to a top cover 30. The cover is slightly larger than the bottom and thus has a peripheral lip that juts out over the sides 29. This lip is provided with reinforced corner slots 31 through which the lifting straps 14 of the bulk bag may extend. An intake spout 32 extends upwardly from an unshown opening in the liner top cover.

Figure 2:
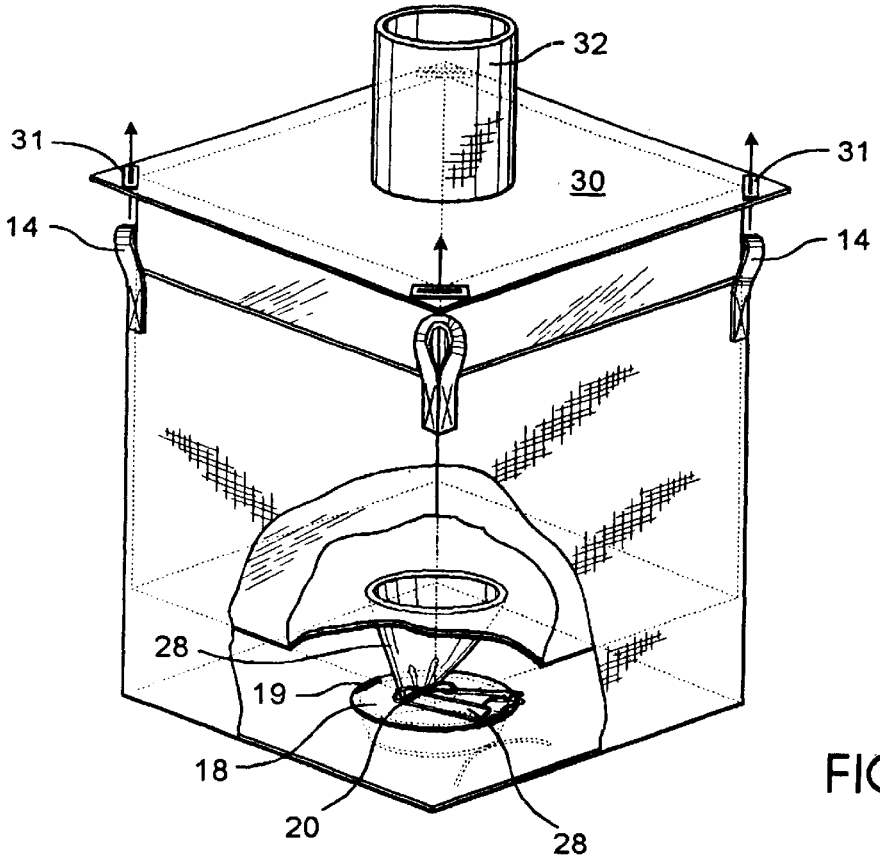
FIG. 2 is a perspective view showing the bulk bag and liner of FIG. 1 substantially assembled.
Figure 3:
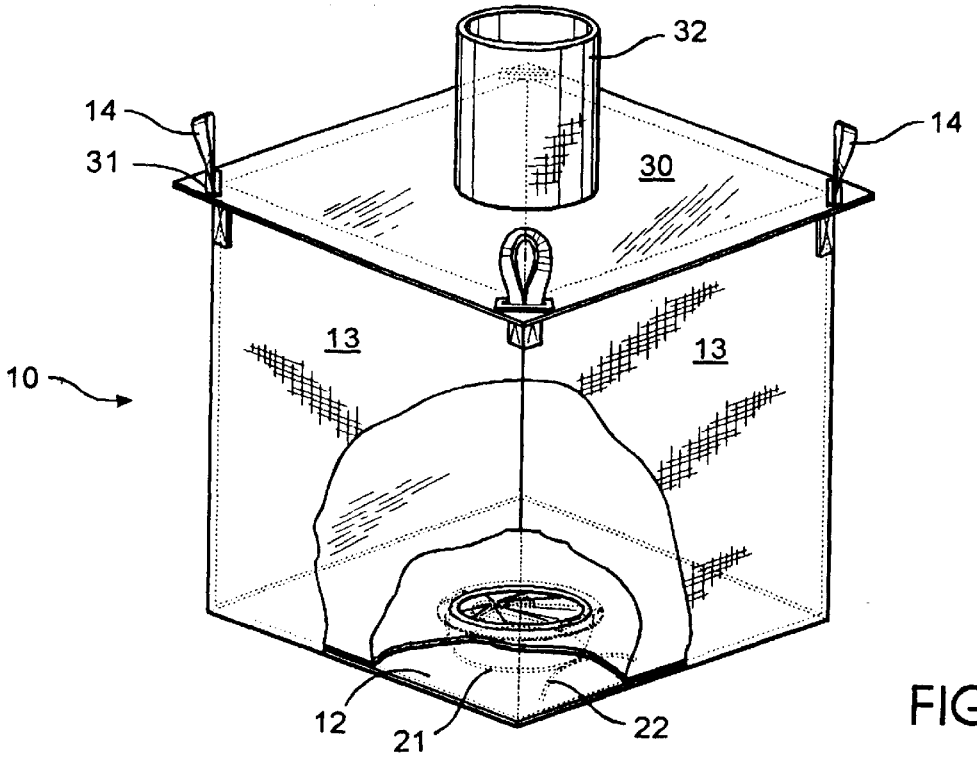
FIG. 3 is a perspective view of the bulk bag and liner of FIG. 1 with the liner fully inserted in the bag thereby lining the bag.

The bulk bag 10 is lined with the liner 25 by inserting the liner into the bag as shown being done in FIG. 2. With the bag flap 18 hinged down, the liner discharge spout 28 is secured to the flap by the tie cord 20. In doing this the cord is drawn tightly about a mid portion of the liner spout, thereby tieing it off. Alternatively, the spout may be fastened to the flap 18 by another cord that is independent of the tie-off cord. The lifting straps 14 are pulled through the slots 31 in fully inserting the liner. The bulk bag sleeve 21 is then drawn closed and tied off by the draw cord 22. The now lined bulk bag may now be filled with material fed down through the liner intake spout 32.

Figure 4:
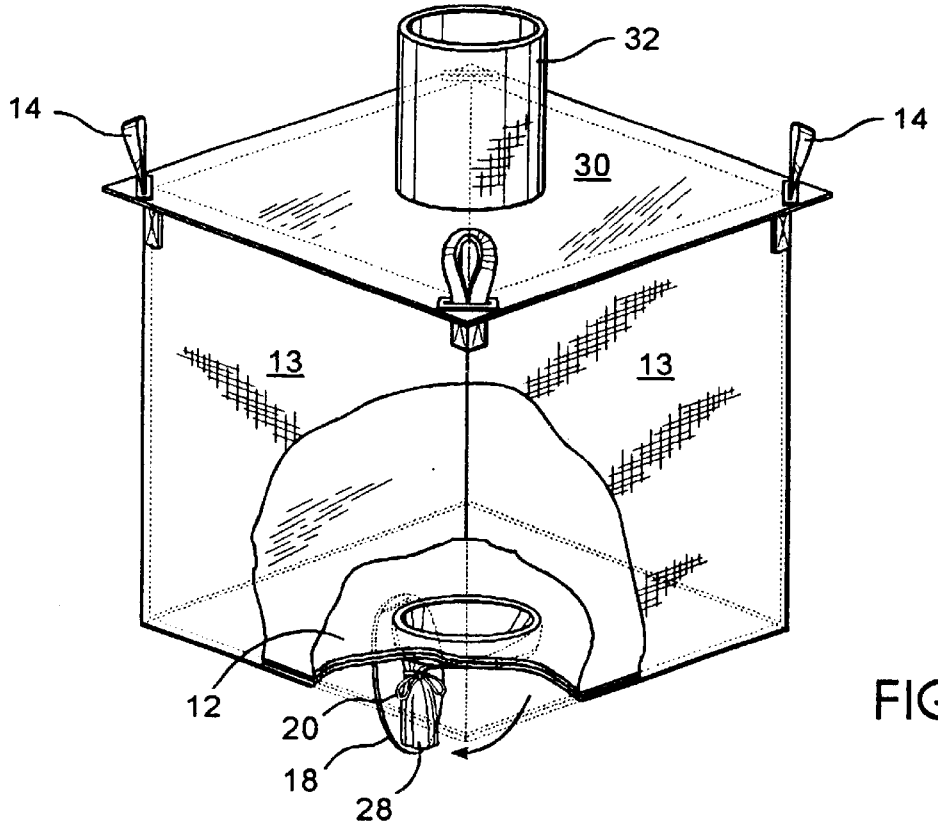
FIG. 4 is a perspective view of the lined bulk bag with a bottom flap in an open position preparatory to bag discharge.
Figure 5:
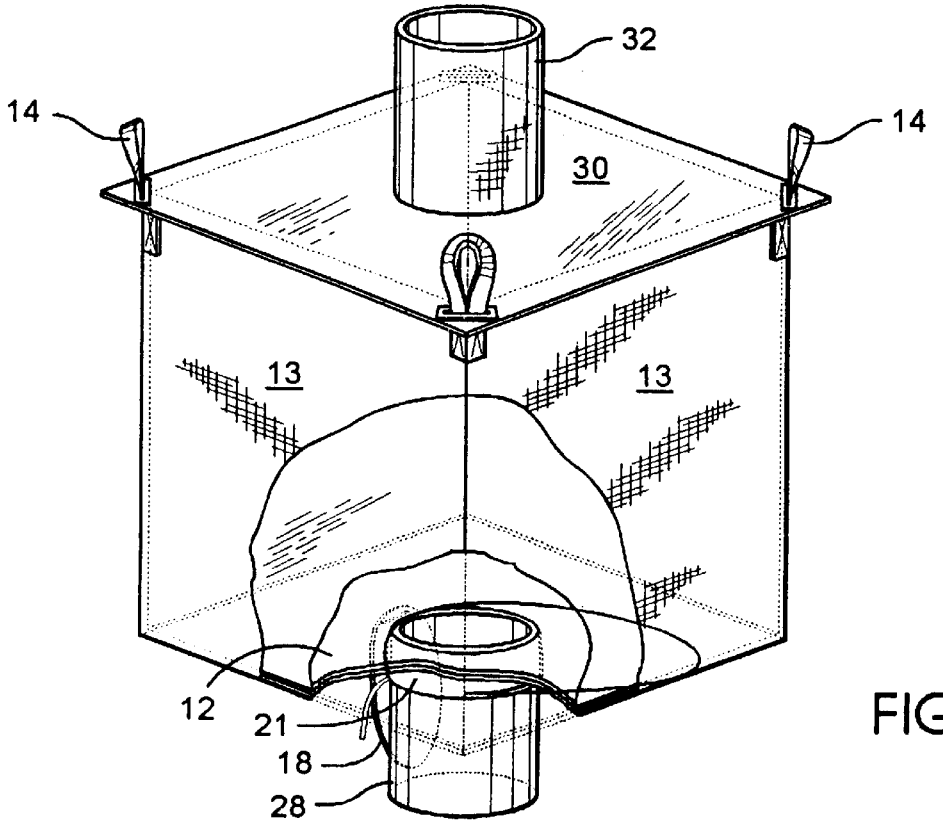
FIG. 5 is a perspective view of the lined bulk bag with the liner spout unfurled and opened for unloading.
Figure 6:
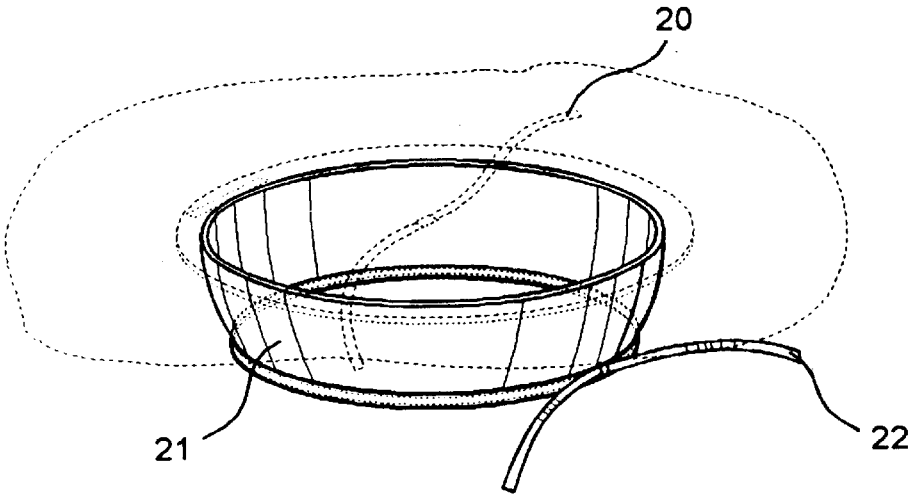
FIG. 6 is an enlarged, perspective view of the bag duffel type closure.

To discharge material and empty the lined bulk bag, it is suspended by the straps 14 over a hopper or other type collector or conveyor. The bag sleeve 22 is untied and opened to expose the flap 18. The periphery of the flap 18 is manually drawn off its overhang at most any place other than at the line of stitching 19. Once freed and gripped, it is swung down as shown in FIG. 4. In swinging the flap down the liner spout 28 and tie off 20 are also drawn down. The now readily accessible tie cord 20 may then be untied whereupon the spout unfurls as shown in FIG. 5 and material begins to gravitate as a stream out of the liner and bag.

Figure 7:
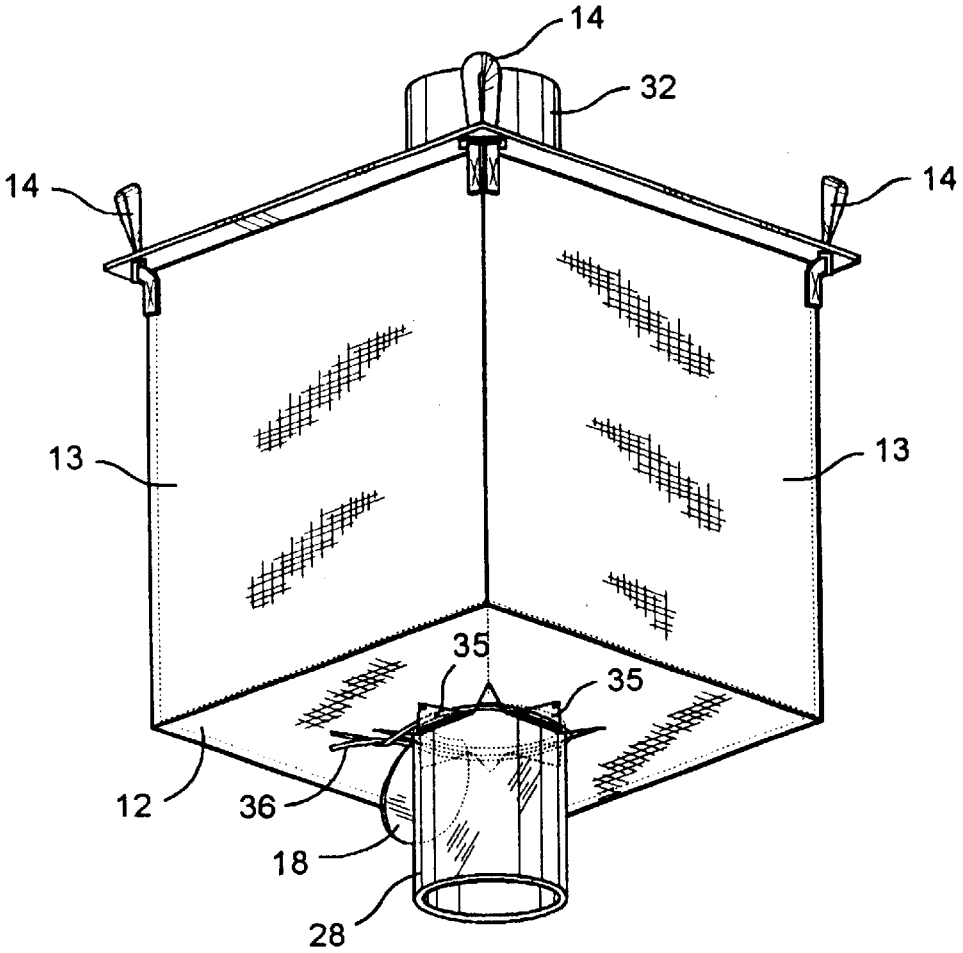
FIG. 7 is a perspective view of the lined bulk bag but with a petal type closure.

The duffle closure in the form of bag sleeve 21 is not required. Alternatively the bulk bag bottom may be closed and opened with a conventional petal closure as shown in FIG. 7. The petal closure has four triangular petals 35 that may be drawn together by a draw string 36 or loosed and spaced apart as shown here. The central gap that is present when a petal closure is drawn is here closed by the flap 18 which is tucked in, as before. Again, the liner discharge spout 28 is tied off and to the flap before being unfurled and opened as shown here.

It thus is seen that a lined bulk bag is now provided which may be readily prepared for discharge in a safe and simple manner. The liner spout is pulled free of its position sandwiched between the liner bottom and bag bottom by simply pulling the flap down. The container may employ either tube liners or fit-to-form type liners. It may be used on both duffle closures as well as petal closures. The need for a bag discharge spout is eliminated. The container may also employ other variations and modifications from those expressly set forth without departure from the spirit and scope of the invention as set forth in the following claims.

What is claimed is:

1. A container for bulk materials comprising a flexible bulk bag having a bag bottom from which bag sides extend, said bag bottom having a bag discharge opening that is closable by a flap hinged to said bag bottom adjacent said bag discharge opening; a flexible liner lining the inside of said bulk bag and having a liner bottom from which liner sides extend, said liner bottom having a liner discharge opening from which a spout depends; and fastening means comprising a tie line secured to said flap for fastening said liner spout to said flap and for releasibly tying off said liner spout, whereby the container may be emptied by pulling the flap to a position opening the bag discharge opening which pulls the liner spout down through the bag opening to expose and render accessible the liner tie off means.

2. A container for bulk materials comprising a flexible bulk bag lined with a flexible tube liner, said bulk bag having a discharge opening covered by a flap and said tube liner having a bottom discharge end fastened to said bag flap and releasibly closed by tie off means, said liner discharge end portion being fastened to said bag flap by said liner tie-off means, whereby the container may be emptied by pulling the flap to a positon opening the bag discharge opening and rendering the liner discharge tie-off means accessible for release.

* * * * *